US006983627B1

(12) United States Patent
Eley-Holden-Sotnik

(10) Patent No.: US 6,983,627 B1
(45) Date of Patent: Jan. 10, 2006

(54) ELASTIC CIRCULAR KNITTING NEEDLE

(76) Inventor: Katherine Marie Eley-Holden-Sotnik, 122 Manhattan Sq., East Wenatchee, WA (US) 98802

( * ) Notice: Subject to any disclaimer, the term of this patent is extended or adjusted under 35 U.S.C. 154(b) by 0 days.

(21) Appl. No.: 11/177,211

(22) Filed: Jul. 9, 2005

(51) Int. Cl.
*D04B 35/02* (2006.01)

(52) U.S. Cl. ..... 66/117

(58) Field of Classification Search ..... 66/1 A, 66/116–118
See application file for complete search history.

(56) References Cited

U.S. PATENT DOCUMENTS 2,096,483 A * 10/1937 Cook ..... 66/117
2,230,495 A * 2/1941 Kohlmann ..... 66/117
3,280,595 A 10/1966 Linstead
4,195,496 A 4/1980 Vasquez et al.
4,553,410 A * 11/1985 Okada ..... 66/117
4,607,505 A * 8/1986 Dunker et al. ..... 66/117
4,646,543 A * 3/1987 Okada ..... 66/117
4,693,094 A 9/1987 Kahn
5,720,187 A 2/1998 Matuo
6,096,012 A 8/2000 Bogert et al.
6,389,655 B2 5/2002 Libecco
6,397,640 B1 6/2002 Williams
6,668,597 B2 * 12/2003 Robinson ..... 66/118

FOREIGN PATENT DOCUMENTS

GB 2100295 A2 * 12/1982

OTHER PUBLICATIONS

Knitdenise.com, Denise Interchangeable TM Knitting Needles, May 28, 2005, pp. 1-3, www.KnitDenise.com, USA.
Royal Yarns International, Crystal Palace Bamboo Circular Needle 16" Long Size 10, Jun. 6, 2005, p. 1, http://gallery.bcentral.com/ . . . , USA.

* cited by examiner

*Primary Examiner*—Danny Worrell

(57) ABSTRACT

A circular knitting needle (20) with an elastic cord (46). Cord (46) has integral connections (38), (40) at each end that are bonded to a pair of needles (26), (28), respectively. Needles (26), (28) are alike and comprise tapered distal tips (22), (24), and tapered proximal bases (34), (36) for ease of manufacturing. The elasticity of cord (46) facilitates the knitting of items with a small circumference, and facilitates the fitting and sizing of partially-knitted items.

10 Claims, 7 Drawing Sheets

Prior-Art

Prior-Art

ELASTIC CIRCULAR KNITTING NEEDLE

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of the Invention

This invention relates to knitting needles used for hand knitting, specifically to an improved cord and connection for a circular knitting needle.

2. Description of the Prior Art

For millenniums items with a small circumference such as socks, mittens, sleeves, and hats, have been knitted in a tubular fashion. Originally knitters used a set of multiple knitting needles to seamlessly knit small accessories of this type. The knitting needles featured a point on each end which allowed them to be arranged in a recyclable pattern. The exclusive attribute of multiple double-point knitting needles were their ability to maneuver with the elastic movement of knitted yarn. However, because double-point knitting needles were rigid and not expansive on their own, they were completely dependant on the stretchy characteristic of the knitted item.

At the present time double-point knitting needles are the main option for knitting small circumferences and the most widely available apparatus for this purpose. Their use requires skill and experience, consumes additional time, and challenges the novice. To use double-points it is necessary to employ four or five needles; three or four needles to carry the work, and one needle to transfer the stitches. Skilled knitters encounter a variety of difficulties: to cast on a row of stitches the needles must be held dexterously, with one hand, in a sequential manner to prevent entanglement, as shown in FIG. 10; after a triangular (three-needle) or a rectangular (four-needle) annulus is formed, as shown in FIG. 11, multiple needle points extend from each corner in a cluttered arrangement and they jab the fingers and wrists during the knitting process; each adjacent needle becomes loose and unwieldy as stitches are knitted from it; and double-points made from metal repeatedly slip out of the stitches and fall away from the work.

Thereafter, inventors created several types of circular knitting needles as an alternative method for seamless circular knitting. Troubles associated with small-circumference knitting have been partially solved by the implementation of flexible circular knitting needles, but these had and still have significant problems.

Ordinary circular knitting needles include a pair of needles attached to a flexible cord such as those shown in FIG. 1 of U.S. Pat. No. 4,693,094 to Kahn dated Sep. 15, 1987. They are unsuitable for knitting an item with a small circumference partly because the minimum length (41 cm or 16 inches) is too long to fit the fewest possible stitches, and partly because the flexible cord cannot give-and-take in a lengthwise direction. If the needles are shortened they become too short for the knitter's hand. If the cord is shortened, then the needles cannot intersect at the tips.

Along with the development of circular knitting needles came the problem of how to join the needles to the cord in a way that prevents the yarn from snagging. Several styles of circular knitting needle connectors have been proposed such as the one shown in FIG. 1 of U.S. Pat. No. 4,693,094 above. Another example is the style used in CRYSTAL PALACE™ brand bamboo circular needles by Crystal Palace Yarns, Richmond, Calif. Although efficient in design, and smoothly transitional, separate connectors are yet another element to manufacture and assemble.

The circular knitting needle shown in FIG. 2 of U.S. Pat. No. 5,720,187, to Matuo, dated Feb. 24, 1998, is designed to be used for small circumferences, yet not to be unduly flexed. The same knitting needle, which is manufactured by Clover Mfg. Co., Ltd., Osaka, Japan, forms a one-piece unit (a minimum of 21 cm or 8.25 inches long), in which one needle is longer than the other. As the shorter needle assists the action of the longer needle intersecting each stitch, the unit is constricted. The flattened cord has a fixed length and a limited bending range. The reluctantly bendable cord compensates for the instability of the undersized needles, but constrains hand movement and does not provide enough room for the fingers.

An unusual apparatus is disclosed in FIG. 1 of U.S. Pat. No. 6,397,640 to Williams, dated Jun. 4, 2002. The invention is a combination of double-point needles circumscribed by a tight cord. The moveable cable travels between two knitting needles without a control mechanism, and the grooves can leave an imprint on the fingers of the knitter. Moreover, this style of circular knitting needle is more difficult to manufacture.

Some flexible circular knitting needles have an additional feature of expandability for fitting garments, as shown in FIGS. 1 and 2 of U.S. Pat. No. 3,280,595 to Linstead, dated Oct. 25, 1966; and also as shown in DENISE INTERCHANGEABLE™ brand expandable circulars by Denise Interchangeable Knitting Needles, Charlottesville, Va. Ideally, during sizing, the stitches do not fall off and the garment remains on the knitting needle. Multiple segments of the flexible cord are connected together in order to elongate the cord. The plastic segments may stretch slightly, which helps to securely hold the end couplings. However, the expansion of the circular knitting needle is dependant on the number of segments. The separate parts require time for assembly and increase the chance for lost or twisted stitches. In addition, there are a multitude of parts to store after the knitting needle is dismantled.

In another example of expandable circular knitting needles, such as that shown in FIG. 2 of U.S. Pat. No. 4,195,496 to Vasquez, dated Apr. 1, 1980, the retractable cord is attached to a reel assembly. As the cord passes through the tubular portion it carries soft fibers that can get caught in the drive belt or form fuzz-balls at the base of the needles. The style and length of cord is limited to the size of the wheel housing. Also, there is a higher probability of mechanical failure.

Thus, to knit a small circumference, one must use awkward or restrictive knitting needles that produce no seam, or else use regular knitting needles and sew up a seam. To fit a garment, one must assemble a kit of needles and accessories, or transfer stitches onto a long piece of yarn. Nevertheless, all the knitting needles heretofore known suffer from a number of disadvantages:

(a) The knitting needles of present use have inadequate flexibility.

(b) A knitting needle cord is flexible yet lacks elastic properties.
(c) Expandability is available only in knitting needles of long lengths.
(d) Lengthwise expansion and contraction requires assembly, disassembly, or mechanical rotation; and is time consuming.
(e) Expandability requires the manufacturing and packaging of multiple parts such as needles, cord, connectors, couplings, and wheel mechanisms.
(f) The knitting needles of present use offer complex and clumsy alternatives for increased flexibility.

OBJECTS AND ADVANTAGES

Accordingly, several objects and advantages of the present invention are:

(a) To recognize and solve the need for elasticity in knitting needles by providing a knitting needle with more flexibility that operates by stretching, and that has stretchy, resilient properties and characteristics.
(b) To provide a knitting needle with an elastic cord.
(c) To provide a knitting needle that has elasticity and is available in a variety of diameters and lengths, and is available in short needles and a short cord.
(d) To provide a knitting needle that can expand and contract lengthwise in one sweeping motion each way, respectively; that stretches without assembly, disassembly, or mechanical rotation; that offers expansion in an autonomous cord.
(e) To provide a knitting needle with expandability that can be manufactured with a simplified design and a minimum of parts.
(f) To provide a knitting needle with a simple combination of two needles and an elastic cord.

Further objects and advantages are to provide a knitting needle which is suitable for knitting items with a small circumference; which does not limit movement but expands with the hands during the knitting process; which requires less skill and experience; and which is suitable for use by beginning knitters. Other objects and advantages are to provide a knitting needle which is expedient for sizing garments; easily expands with a garment during its fitting on a person; saves time; and has low maintenance. Still further objects and advantages of my invention will become apparent from a consideration of the drawings and ensuing description.

SUMMARY

In accordance with the present invention a circular knitting needle comprises an elastic cord having ends which are bonded to a pair of knitting needles.

DRAWINGS

1. Brief Description of the Figures

2. Reference Numerals

| | |
|---|---|
| 20 circular knitting needle | |
| 22 distal tip | 24 distal tip |
| 26 needle | 28 needle |
| 27 shaft portion | 29 shaft portion |
| 30 terminus | 32 terminus |
| 34 proximal base | 36 proximal base |
| 38 connection | 40 connection |
| 41 narrow taper | 43 narrow taper |
| 42 cord taper | 44 cord taper |
| 45 wide taper | 47 wide taper |
| 46 elastic cord | 48 cord surface |
| 49 elongated position | |
| 50 base surface | 52 base surface |
| 54 main position | 56 secondary position |
| 55 triangular annulus | 57 obtuse annulus |

DETAILED DESCRIPTION

1. FIGS. 1, 2, 3, 4, and 5—Preferred Embodiment

Figure 1:
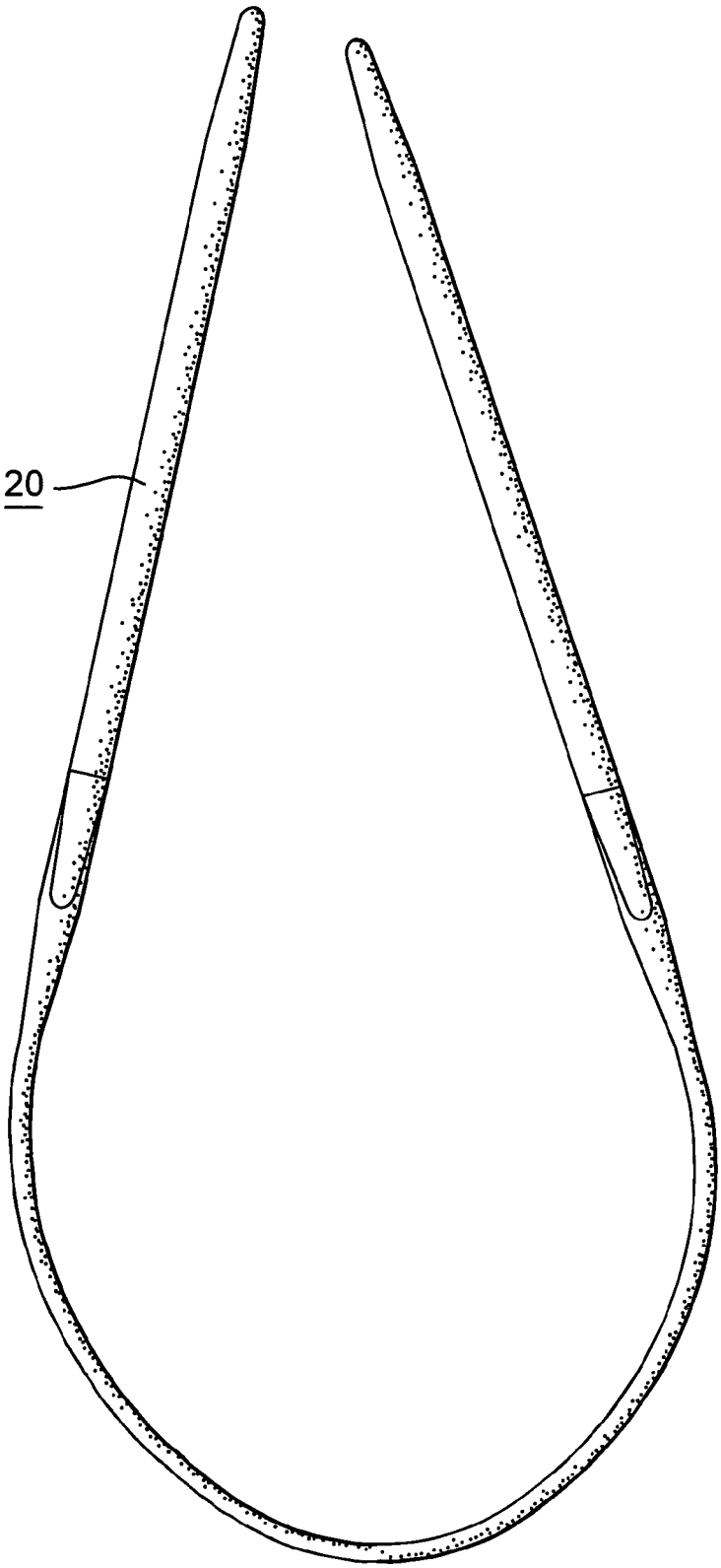
FIG. 1 is a perspective view showing a circular knitting needle according to the present invention.
Figure 2:
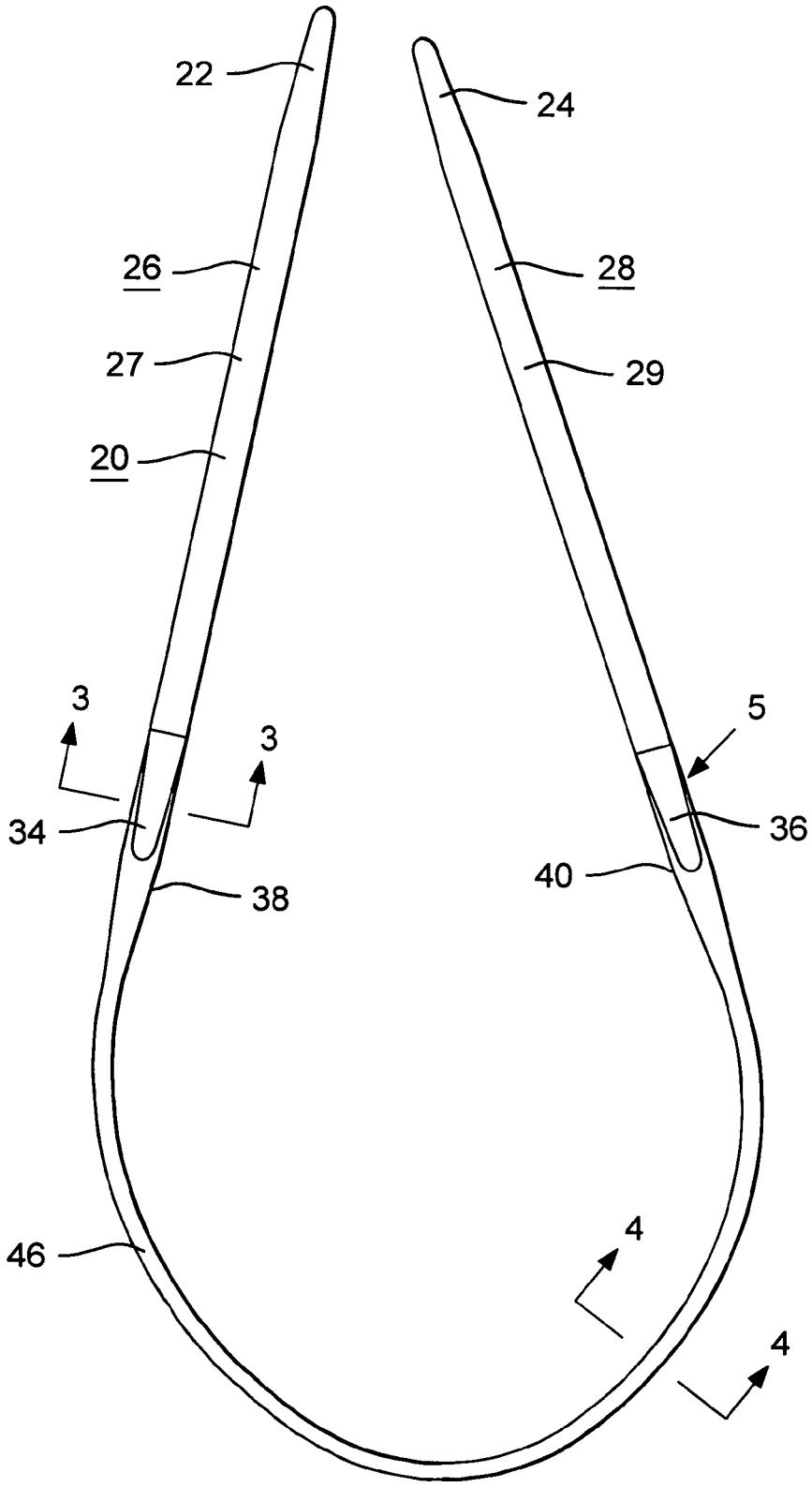
FIG. 2 is a plan view of the same needle.

A preferred embodiment of an elastic circular knitting needle (20) of the present invention is illustrated in FIGS. 1 and 2 of the accompanying drawings. Referring to FIG. 2, circular knitting needle (20) comprises an elastic cord (46) having a connection (38), (40) at each end coated onto a pair of needles (26), (28). The needles are identical so a description of one suffices for the other. The connections are the same so a description of one suffices for the other.

Needles (26), (28) each have a shaft portion (27), (29), with a distal tip (22), (24) at a distal end and a proximal base (34), (36) at a proximal end. Needles (26), (28) comprise rigid dowels of equal lengths and equally circular cross sections common to knitting needles. However, the needles may be uneven lengths and unequal cross sections. In the preferred embodiment, needles (26), (28) are made out of a strong, flexible material such as bamboo. However, needles (26), (28) can comprise any other firm, smooth material that can repeatedly be used to knit loops without splintering or fracturing, such as plastic or resin material, metal, wood, natural material, recycled material, synthetic material, etc. Shaft portion (27), (29) of needles (26), (28) is not limited to straight dowels but can comprise a variety of extended shapes such as a curve, an L-shape, or angled inclinations or any combination thereof. Also, needles (26), (28) are not limited to natural colors but can vary in colors that include pigmented solids, patterned designs, logos, embedded speckles or shapes; and can be glow-in-the-dark, translucent, metallic, or reflective.

Each distal tip (22), (24) has a standard shape and length, such as tapered, common to ordinary knitting needles. For convenience of manufacturing, proximal bases (34), (36) are identical to tips (22), (24). However, bases (34), (36) can comprise any other shape and length that can resist breaking off such as a rounded or a threaded shape. In the preferred embodiment, tips (22), (24) and bases (34), (36) are integral with shaft portion (27), (29), but can be prepared separately from the shaft portion and later connected thereto in a known manner. Needles (26), (28), including tips (22), (24) and bases (34), (36), are pre-finished with a polyurethane sealant, yet may be lightly stained, buffed, waxed, or resin impregnated. Also, the bases may be sanded or chemically treated for an optional roughened surface.

Figure 4:
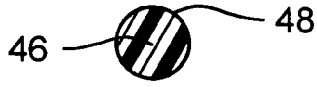
FIG. 4 is an enlarged section of a cord taken along lines 44 in FIG. 2.

Elastic cord (46) is a flexible and expandable segment which includes integral connections (38), (40) at each end, respectively. As shown in FIG. 4, cord (46) has a solid round cross section. However, a variety of other cross-sectional shapes may be used for cord (46) such as any combination of flattened, rectangular, triangular, polygonal, circular, floral, tubular, imprinted, or dimpled cut; any of which may be solid, hollow, braided, stubbed, symmetrical, or asymmetrical. Cord (46) has a cord surface (48) which is smooth so knitted stitches can easily slide across it. In the preferred embodiment, referring to FIG. 2, cord (46) is made of a proprietary formula of clear elastic plastic, such as STRETCH MAGIC® brand bead and jewelry cording, available from Pepperell Braiding Co., Inc., Pepperell, Mass. However, cord (46) can be made of any other resilient material such as silicone rubber, flexible rubber, rubbery compound, recycled rubber material, resin, polymer, elastomer, plastomer, plastic, any combination of natural or synthetic compound, etc., that has the following qualities: is strong and stretchy; is firm enough to resist kinking at connections (38), (40); is able to rebound to original form; does not distort after expansion and contraction; can endure repetitive motion; easily and permanently adheres to bases (34), (36); and provides a smooth, tack-free surface. In addition, cord (46) may be translucent, pigmented, speckled, colorfully patterned, reflective, glow-in-the-dark, or metallic.

Figure 3:
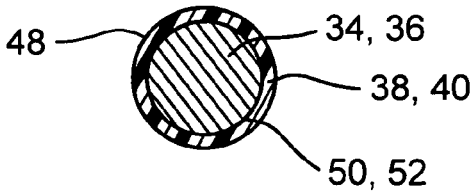
FIG. 3 is an enlarged section of a proximal base taken along lines 3—3 in FIG. 2.
Figure 5:
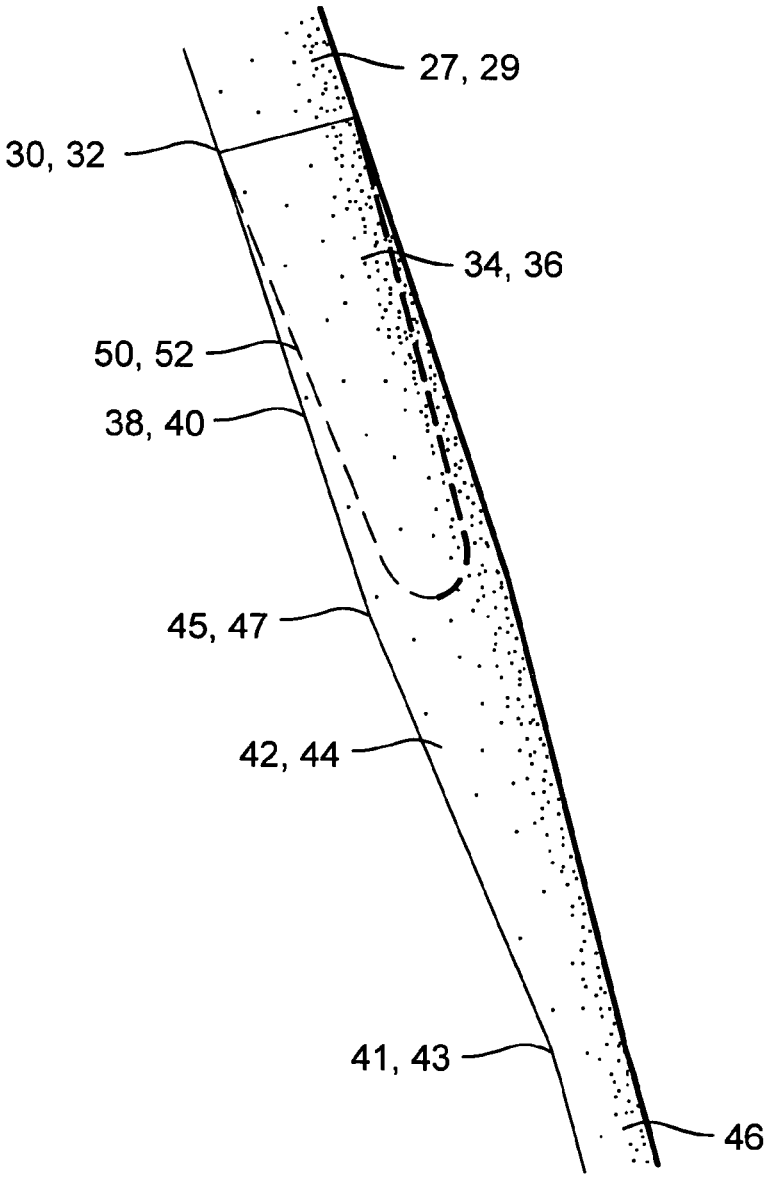
FIG. 5 is an enlarged detail of a connection.

As is best illustrated in FIG. 5, connections (38), (40) are a coated material layer bonded to bases (34), (36) by a known method. However, connections (38), (40) are not limited to a coated layer but can be preformed, such as in the shape of an internally threaded mold. Connections (38), (40) each have a cord taper (42), (44), although the connections can include other tapered or non-tapered shapes such as spherical, oval, or any style used in the main length of cord (46). Each cord taper (42), (44) begins at a narrow taper (41), (43), flares in a gradual and uniform diameter to a wide taper (45), (47), then continues over base (34), (36) until the taper terminates in a smooth blend at a terminus (30), (32). As shown in FIG. 3, connections (38), (40) completely and uniformly surround bases (34), (36) and have a smooth cord surface (48). Bases (34), (36) each have a base surface (50), (52) which is clean and free of contamination previous to an application of connections (38), (40).

Referring to FIG. 2, cord (46) and connections (38), (40) are fashioned with one or more elastic plastic material that can be formed through a plurality of techniques including such as but not limited to injection molding, low temperature coating, cold state processing, extrusion coating, coextrusion, etc., or a combination thereof as may be determined by those skilled in the art. The application of connections (38), (40) may be done at a standard specification recommended by a manufacturer, or with a process that is safe and mild so that it does not weaken the integrity of needles (26), (28) and connections (38), (40). The final result is cord (46) streamlined to needles (26), (28) by its own melded ends.

Circular knitting needle (20) is manufactured with different dimensions according to its particular use; such as for knitting small circumferences, or for sizing larger garments. As shown in FIG. 2 or FIG. 5, the following dimensions for the preferred embodiment are common for both purposes: tips (22), (24) and bases (34), (36) vary in proportion to the diameter of needles (26), (28); the length of cord tapers (42), (44) is about the same length as bases (34), (36); the diameter of cord tapers (42), (44) transitions between the diameters of the narrow tapers and of the wide tapers, respectively; the diameter of narrow tapers (41), (43) equals the diameter of elastic cord (46); the diameter of wide tapers (45), (47) matches the diameter of shafts (27), (29); the diameter of terminuses (30), (32) closely blends to match the diameter of shafts (27), (29).

The following are optimum dimensions of circular knitting needle (20) used for knitting items with small circumferences: the overall length of circular knitting needle (20) is about 24.77 cm (9.75 inches), but can be 20 cm to 26 cm (8" to 10") long depending on the properties of the elastic cord; needles (26), (28) seem to work best if the length is the same as an ordinary tapestry needle, roughly 6.67 cm (2.625"), which includes tips (22), (24) and bases (34), (36); shaft portions (27), (29) are a standard diameter from 0 mm to 5 mm; the total length of cord (46) is about 15.25 cm (6") long including connections (38), (40); the diameter of cord (46) is a standard 1.5 mm, but can be 1.0 mm to 1.8 mm depending on its elastic properties.

The following are optimum dimensions of circular knitting needle (20) used for knitting items with a larger circumference, for sizing, or for fitting garments: the overall length of circular knitting needle (20) includes standard lengths such as 16", 20", 26", 30", 36", 48", and 60", but can vary by being shorter or longer; needles (26), (28) are standard lengths ranging from 8.5 cm to 15.5 cm (3.5" to 6") including tips (22), (24) and bases (34), (36); shaft portions (27), (29) are a standard diameter ranging from 0 mm to 35 mm; cord (46) is a standard diameter ranging from 1.0 mm to 2.0 mm depending on the diameter of shaft portions (27), (29) and depending on the elastic properites of the cord.

2. FIGS. 6, 7, 8, and 9—Operation

Figure 8:
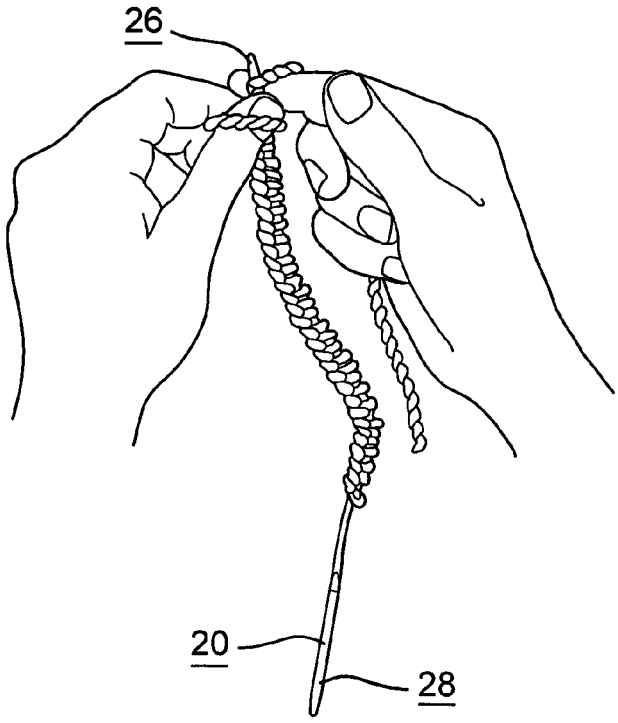
FIG. 8 shows a knitting operation of cast-on stitches according to the present invention.
Figure 9:
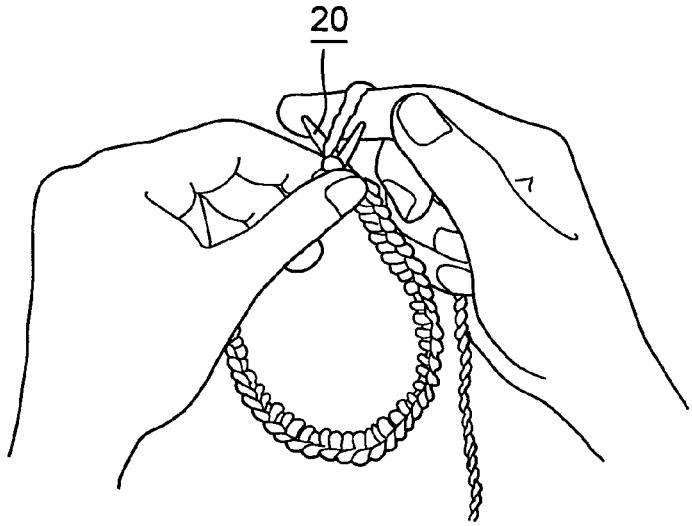
FIG. 9 shows a circular annulus according to the present invention.
Figure 10:
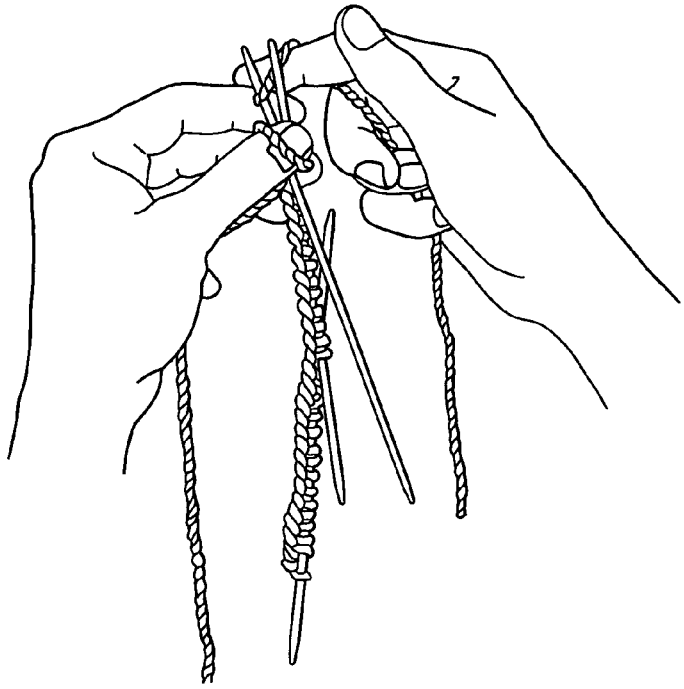
FIG. 10 shows a knitting operation of cast-on stitches using prior art double-point knitting needles.
Figure 11:
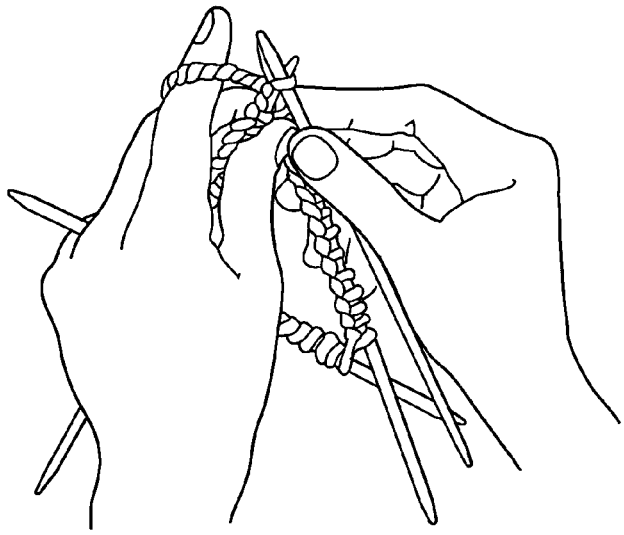
FIG. 11 shows a triangular annulus using prior art double-point knitting needles.

In reference to FIG. 8, the manner of using circular knitting needle (20) to knit items of a small circumference is identical to that for circular knitting needles in present use. Namely, one first forms loops of yarn, by hand, onto one of the needles (26), (28) for a row of cast-on stitches. Next, as shown in FIG. 9, one pulls the needles together so that they are positioned perpendicularly to one another and so that circular knitting needle (20) forms a circular annulus.

Figure 6:
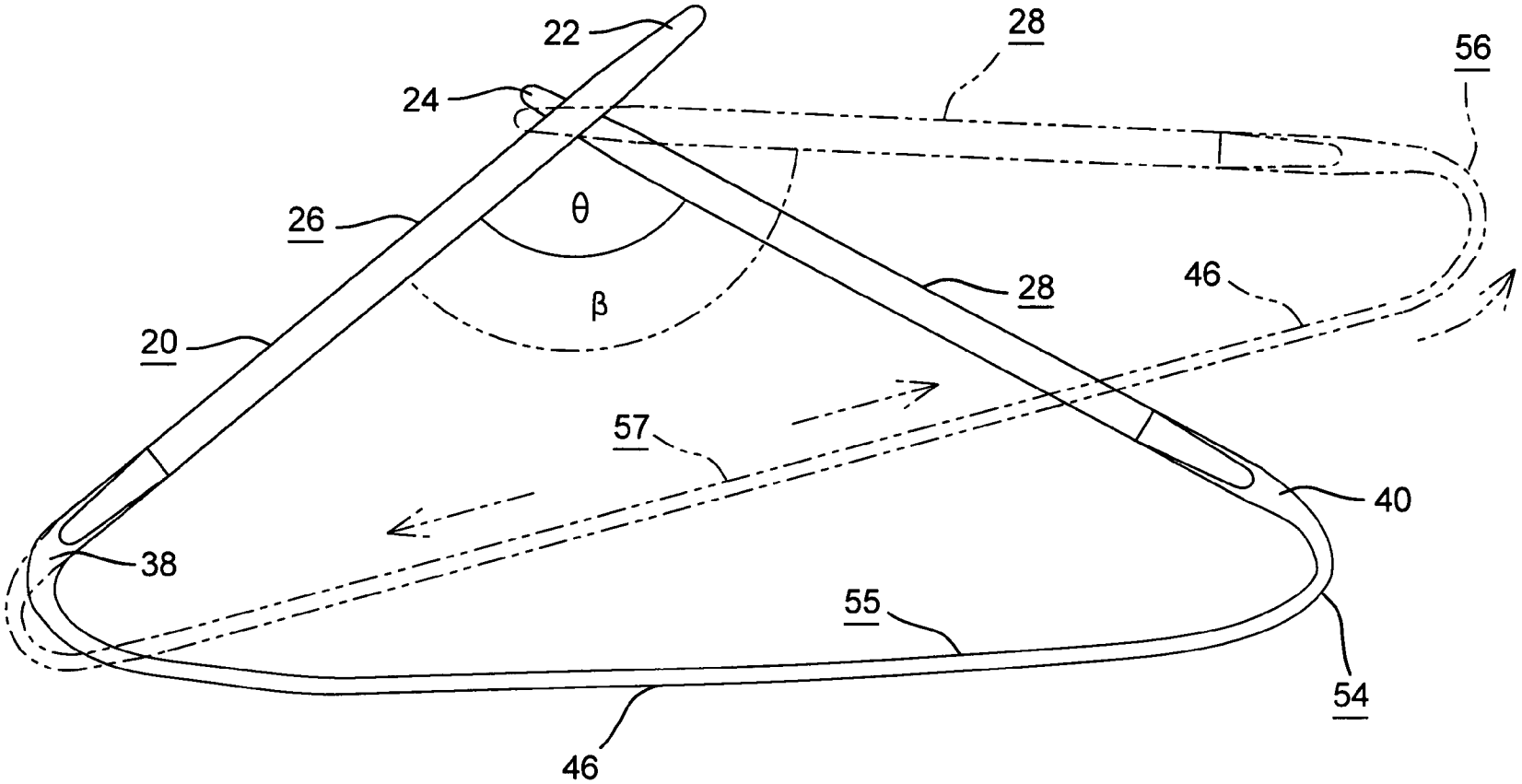
FIG. 6 shows a main and a secondary position according to the present invention.

The positions for knitting small circumferences are shown in FIG. 6. To knit a stitch, one first inserts tip (24) into a loop of yarn held by tip (22). The insertion generally occurs in one of two ways: 1) at an angle ($\theta$) to form a knit-stitch as shown in main position (54), or 2) at an angle ($\beta$) to form a purl-stitch as shown in secondary position (56).

To form the knit-stitch, needles (26), (28) intersect at angle ($\theta$) that is approximately 80° to 115° depending on personal preference. Angle ($\theta$) is dependant on the flexibility of cord (46). Circular knitting needle (20) is thereby shaped into a triangular annulus (55). Meanwhile, the loop of yarn acts as a hinge for tips (22), (24), and the other stitches rest along the length of circular knitting needle (20).

To form the purl-stitch, needles (26), (28) intersect at angle ($\beta$) that is approximately 135° to 145° depending on personal preference. Angle ($\beta$) is dependant on both the flexibility and elasticity of cord (46). Circular knitting needle (20) is thereby stretched into an obtuse annulus (57). Cord (46) facilitates the process of forming an obtuse annulus (57) because it simply stretches with the hands as necessary—about 15% to 20%. Thus, since cord (46)

expands and contracts, it avoids the limited flexibility that plagues prior-art circular knitting needles.

To finish the knit-stitch or purl-stitch, one wraps the yarn around tip (24) and retracts the tip and yarn back through the loop, which thereby creates a new stitch on the needle (28). The insertion and retraction motions both rely on the flexibility and elasticity of cord (46). One typically holds the annulus so that the fourth and fifth fingers put pressure on connections (38), (40). The connections contour to the fingers to facilitate the hold. Thus, since connections (38), (40) are pliable and curve easily, they avoid the stiffness and reluctance to bend that burdens prior-art knitting needles.

Figure 7:
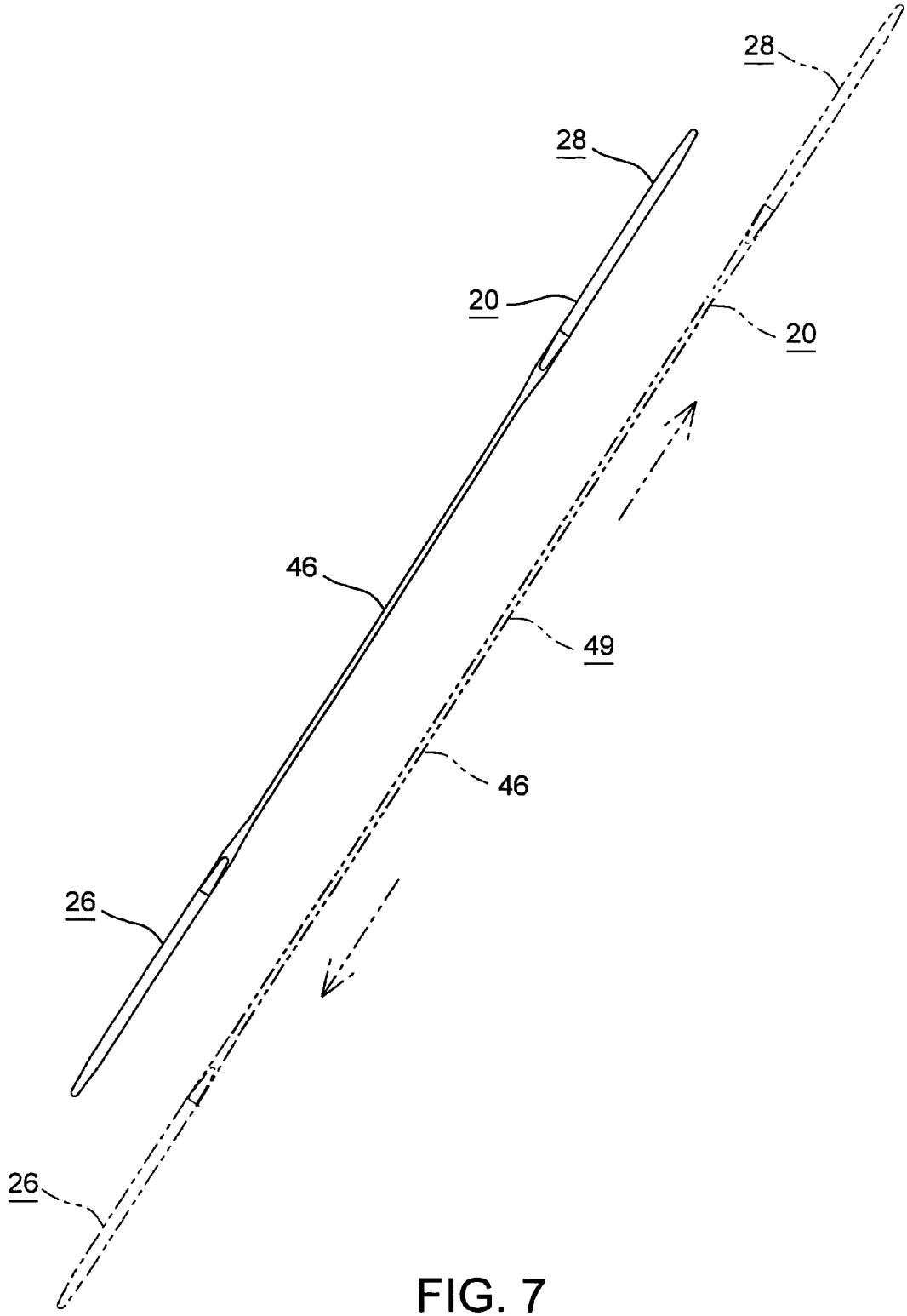
FIG. 7 shows a main position and an elongated position according to the present invention.

Compared to expandable knitting needles in present use, the manner of using circular knitting needle (20) to fit garments is greatly simplified. One partially knits an item, as described above, and leaves it intact on circular knitting needle (20). For sizing flat-work that is knitted with seamed edges, needles (26), (28) are each taken in a separate hand and simply pulled in the opposite direction as shown in FIG. 7. As cord (46) stretches into an elongated position (49), the item is wrapped around a person or an object. For sizing tubular-work that is knitted seamlessly, both needles (26), (28) are held in one hand, or loosely tied together, or latched together by a known means (not shown). With the knitted item still attached to circular knitting needle (20), one pulls the entire knitted unit over a person or an object, such as in the conventional manner of donning clothing (not shown). Thus, since cord (46) expands with the knitted unit—about 50%—it avoids the assembly and disassembly that prior-art circular knitting needles require.

3. Conclusions, Ramifications, and Scope

From the description above, a number of advantages of my elastic circular knitting needle become evident. The circular knitting needle can flex with the hands, making it easy to knit small tubular items. Skilled knitters will find them efficient to use, and novices will find them easier to learn with. In addition, when the circular knitting needle is used to knit larger items, or to fit garments, the elastic cord will conveniently stretch in an instant. It effortlessly returns to original form so knitting can resume, or so it can be stored immediately. The high durability and the permanent bond of the elastic cord can resist the abuses of normal knitting and fitting, obviating the need to repeatedly order parts to continue its function.

Accordingly, the circular knitting needle has additional advantages. It provides a knitting needle that is not dependant on elasticity of knitted yarn, on limited cord flexibility, on moving parts, or on detachable parts. It has its own stretchy, rebounding properties and characteristics. It offers expansion in a single cord that acts autonomously. Furthermore, it provides a knitting needle with a cord that is flexible and elastic at the same time. It permits a knitting needle to expand and contract lengthwise without assembly, disassembly, or mechanical rotation. One stretched elastic cord can equal the same length as a plurality of flexible cords pieced together. It provides a knitting needle that can be stretched with little effort; that elongates easily when pulled and contracts when relaxed. It provides a knitting needle with an innovative combination of needles and elastic cord bonded together by the cord itself, thereby reducing the number of parts, and obviating the need for separate connectors.

The present invention may be varied in many ways. For instance the needles can be made integral with the cord. The integral needles and cord can comprise a plurality of materials that are treated, chemically for example, so that the cord is softened to elasticity and so that the needles are hardened to rigidity.

Yet on the other hand, the elastic cord can be attached to the needles with separate connectors made of a different material, such as metal. Standard elastic cord is available in rolls that can be precut into segments. Knitting needle manufacturers that currently use separate connectors will be able to easily switch from flexible cord to elastic cord. The segments of elastic cord can be shaped easily, by low temperature methods for example, to suitably accommodate separate connectors. Moreover, in the case where the needles are connected to the cord with separate connectors, the needles, cord, or connectors, may be detachable to allow each of the parts to be changed to a different size.

Such variations should not be regarded as limiting the scope of the invention, and all such variations as would be obvious to those skilled in the art are intended to be included in the following claims. The scope of the invention should be determined by the claims and their legal equivalents, rather than by the examples given.

I claim:

1. A circular knitting needle comprising:

an elastic cord;

a first knitting needle connected to a first end of said elastic cord; and a second knitting needle connected to a second end of said elastic cord;

wherein said first knitting needle and said second knitting needle each comprise a shaft portion, a tip at a distal end, and a base at a proximal end; and wherein said elastic cord comprises an expandable segment and a first connection and a second connection;

wherein said first connection and said second connection comprise a coated material layer bonded to the base of said first knitting needle and to the base of said second knitting needle, respectively;

whereby said elastic cord stretches so as to enable said circular knitting needle to expand and contract.

2. The circular knitting needle of claim 1 wherein said elastic cord has resilient plastic properties.

3. The circular knitting needle of claim 1 wherein said first connection and said second connection are integral with said elastic cord.

4. In combination, a circular knitting needle comprising:

a first knitting needle and a second knitting needle;

the improvement wherein said first knitting needle and said second knitting needle are attached to an expansion means for instantaneous elongation of said circular knitting needle;

wherein said expansion means comprises an expandable segment and two connection means;

wherein each said connection means for attaching said expandable segment comprises a coated material layer;

whereby said expansion means activates under tension and provides expansion and contraction in said circular knitting needle so that a partially knitted item can be knitted and sized conveniently.

5. The circular knitting needle of claim 4 wherein said expansion means is an elastic cord.

6. The circular knitting needle of claim 5 wherein said elastic cord is made of a resilient plastic material.

7. The circular knitting needle of claim 4 wherein said expandable segment and said two connection means are integral.

8. A method of expanding and contracting a hand-knitting apparatus, comprising:

providing a circular knitting needle of the type comprising a pair of needles each having a distal tip and a proximal base, and an elastic cord having a connection at each end bonded to the proximal bases of said pair of needles;

providing a partially knitted item remaining intact on said circular knitting needle;

gripping said pair of needles, one in each hand, and pulling the needles in opposite directions so that said elastic cord expands;

relaxing said pair of needles so that said elastic cord contracts;

holding said pair of needles so that said circular knitting needle forms an annulus;

radially moving said pair of needles and swinging each said proximal base away from and toward the other;

locking said pair of needles together in a known manner so that they form a barrier to hold said partially knitted item from sliding off said circular knitting needle;

gripping said elastic cord and pulling said annulus and knitted item in a plurality of directions so that said elastic cord expands;

relaxing said annulus and knitted item so that said elastic cord contracts;

whereby said circular knitting needle will stretch and relax, and a knitter can knit and size a partially knitted item, and the knitted item is expanded and contracted in a simple fashion without restriction and without other elements.

9. The method of claim 8 wherein said elastic cord and each said connection are integral.

10. The method of claim 8 wherein said elastic cord and each said connection are composed of a resilient plastic material.

* * * * *